United States Patent [19]

Brüssel

[11] Patent Number: 4,982,638

[45] Date of Patent: Jan. 8, 1991

[54] PNEUMATICALLY OPERATED CUTTING DEVICE

[75] Inventor: Richard Brüssel, Sulzfeld, Fed. Rep. of Germany

[73] Assignee: Fried. Krupp Gesellschaft Mit Beschränkter Haftung, Essen, Fed. Rep. of Germany

[21] Appl. No.: 312,008

[22] Filed: Feb. 17, 1989

[30] Foreign Application Priority Data

Feb. 19, 1988 [DE] Fed. Rep. of Germany ..... 3805164

[51] Int. Cl.[5] ..... B26D 5/12

[52] U.S. Cl. ..... 83/614; 83/62.001; 83/639.001

[58] Field of Search ..... 83/639, 614, 62, 62.1, 83/639.1, 639.2, 639.4, 639.3, 639.5, 752, 365; 60/413, 418, 416

[56] References Cited

U.S. PATENT DOCUMENTS

| | | | |
|---|---|---|---|
| 3,213,735 | 10/1965 | Keferstein et al. | 83/614 X |
| 3,277,761 | 10/1966 | Dreher | 83/614 |
| 3,779,121 | 12/1973 | Lagain | 83/639 X |
| 3,893,377 | 7/1975 | Mannetje | 60/416 X |
| 4,099,435 | 7/1978 | Young | 83/614 |
| 4,340,326 | 7/1982 | Buonauro et al. | 408/16 |
| 4,481,768 | 11/1984 | Goshorn et al. | 60/415 |
| 4,558,686 | 12/1985 | Ono | 125/13 R |
| 4,785,698 | 11/1988 | Stork | 83/614 X |

*Primary Examiner*—Frank T. Yost
*Assistant Examiner*—Rinaldi Rada
*Attorney, Agent, or Firm*—Spencer & Frank

[57] ABSTRACT

A cutting device for severing sheet material comprises a pneumatic cylinder defining a cylinder chamber having opposite first and second ends; a piston longitudinally slidably received in the cylinder chamber for executing working strokes between the first and second ends; a cutting blade situated at least partially externally of the cylinder and being secured to the piston for travel with the piston as a unit; a pressurized air vessel; and a first and a second switching valve connected to the respective ends of the cylinder chamber and to the presurized air vessel. Each switching valve has a first position in which pneumatic communication is maintained between the pressurized air vessel and a respective cylinder chamber part and a second position in which the respective cylinder chamber part is vented. The device further has an assembly for recharging the pressurized air vessel with pressurized air to a predetermined pressure solely prior to each working stroke of the piston and for allowing the pressure to diminish in the pressurized air vessel during each working stroke of the piston. There is further provided an arrangement for coordinating operations of the first and second switching valves and the recharging assembly.

11 Claims, 1 Drawing Sheet

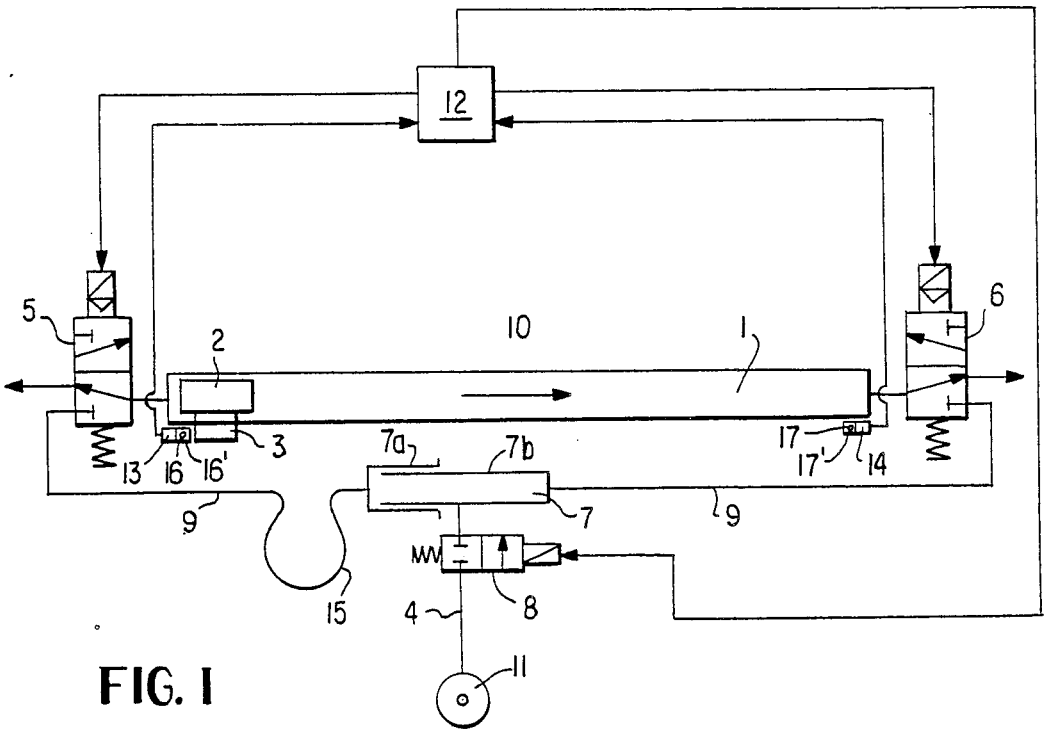
FIG. 1
FIG. 2
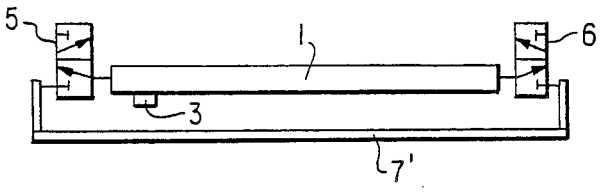
FIG. 3
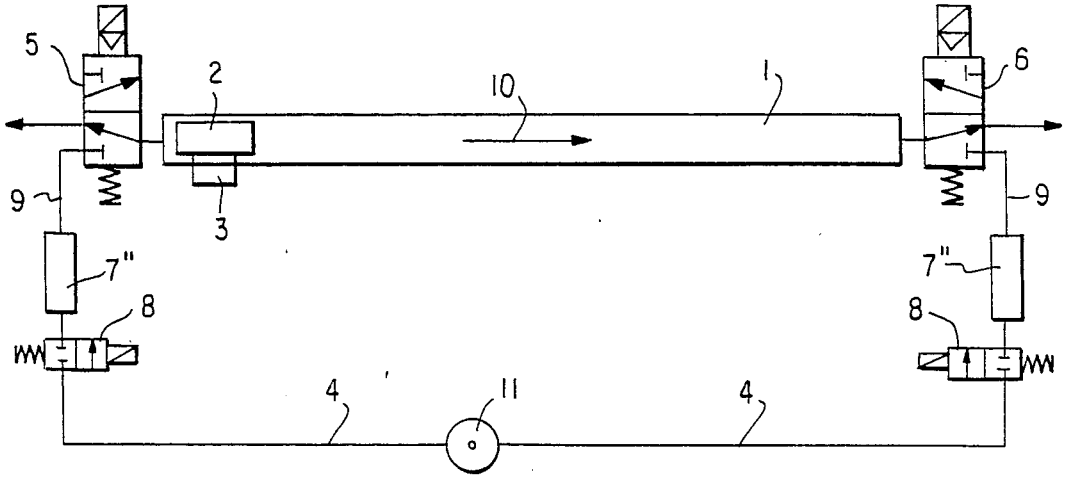

PNEUMATICALLY OPERATED CUTTING DEVICE

CROSS REFERENCE TO RELATED APPLICATION

This application claims the priority of Federal Republic of Germany Application No. P 38 05 164.8 filed Feb. 19th, 1988, which is incorporated herein by reference.

BACKGROUND OF THE INVENTION

This invention relates to a cutting device particularly for resin sheets pulled from a supply reel The resin sheet is provided in its stored state at least on one face with a film which is removed prior to the cutting operation. The cutting device has a blade secured to mounting means operated by a pneumatic drive.

Resin sheets severed with a cutting device of the above-outlined type are often used as blanks for being deformed in molding presses. Before the resin sheets are introduced into the press, they are, as a rule, superposed in a plurality to form a stack to be received in the press.

Since known cutting devices which include a circulating chain drive have been found to have excessively low cutting speeds and therefore are not adapted to the requirements of a high-output manufacturing method, it has already been suggested to use a pneumatic drive for the cutter blade. Such pneumatic drives, however, have the disadvantage that despite a relatively large energy input the speed cannot be augmented to reach the required level. In order to achieve high speeds not only large-dimension valves and conduits for the pressure medium are necessary but complex arrangements have to be provided to brake the piston of the pneumatic cylinder for decelerating it from a high speed This means that not only complex and large damping devices have to be used, but after each cutting step a large amount of the inputted energy remains unutilized and is thus wasted.

SUMMARY OF THE INVENTION

It is an object of the invention to provide an improved cutting device of the above-outlined type which utilizes less energy for each cutting operation without the need for a complex structure.

This object and others to become apparent as the specification progresses, are accomplished by the invention, according to which, briefly stated, the cutting device for severing sheet material comprises a pneumatic cylinder defining a cylinder chamber having opposite first and second ends; a piston longitudinally slidably received in the cylinder chamber for executing working strokes between the first and second ends; a cutting blade situated at least partially externally of the cylinder and being secured to the piston for travel with the piston as a unit; a pressurized air vessel; and a first and a second switching valve connected to the respective ends of the cylinder chamber and to the pressurized air vessel. Each switching valve has a first position in which pneumatic communication is maintained between the pressurized air vessel and a respective cylinder chamber part and a second position in which the respective cylinder chamber part is vented. The device further has an assembly for recharging the pressurized air vessel with pressurized air to a predetermined pressure solely prior to each working stroke of the piston and for allowing the pressure to diminish in the pressurized air vessel during each working stroke of the piston. There is further provided an arrangement for coordinating operations of the first and second switching valves and the recharging assembly.

By virtue of the cutting device according to the invention, the large-energy input at the beginning of the cutting operation effects a high acceleration of the cutting blade. Despite the diminishing pressure applied to the piston as the latter executes the cutting stroke, it has been surprisingly found that the initial kinetic energy imparted on the piston is wholly sufficient for the entire cutting step. By virtue of the large initial acceleration even relatively floppy (limp) edge zones of resin sheets which have no edge cuts and which otherwise can be cut only with difficulty, can be severed with a clean cut so that a preparatory edge cutting operation may be dispensed with.

It is an additional significant advantage of the invention that braking (dampening) devices at the end of the piston stroke may be practically dispensed with, because the energy which drives the piston is substantially entirely used up at the end of the set cutting stroke. This results in a significantly greater service life of the components exposed to wear, and furthermore, the wear and the operational noise of the cutting device are greatly reduced. While in known cutting devices the piston continues to be exposed to the full operating pressure even in its position of rest after performing a cutting stroke, such a significant energy waste does not occur in the device according to the invention.

By virtue of the fact that the pneumatic cylinder of the cutting device according to the invention may be operated alternately from both sides, in each direction of motion a cutting step may be performed and thus an idle return motion of the tool into an initial position subsequent to a cutting step may be dispensed with. Accordingly, the movable blade is designed to perform a cutting operation in either direction of motion.

The frequency of the cyclical operation may be accelerated according to a further feature of the invention by providing that both switching valves each are connected with a separate compressed air vessel. As a result, the pressure vessel may be recharged during the discharge of the other vessel.

In case only a single compressed air vessel is used for both cutting directions, according to a further feature of the invention the compressed air vessel is constituted by an appropriately dimensioned connecting conduit between the two switching valves This results in a further simplification of the construction.

For the rapid recharging and/or adaptation to the required energy quantity, according to a further feature of the invention a metering valve (charging valve) is connected upstream of the compressed air storage vessel.

According to another feature of the invention, for the adaptation of the required energy quantity, the compressed air storage vessel is of variable volume.

BRIEF DESCRIPTION OF THE DRAWING

FIGS. 1, 2 and 3 are schematic side elevational views of three preferred embodiments of the invention.

DESCRIPTION OF THE PREFERRED EMBODIMENT

Turning now to FIG. 1, the cutting device illustrated therein comprises a pneumatic cylinder 1 in which a piston 2, carrying a cutting blade 3 is axially slidably guided. The piston 2 divides the cylinder volume into two chamber parts at the left and at the right side of the piston, respectively. The opposite ends of the pneumatic cylinder 1 are connected to a respective 2-position, 3-ported solenoid valve 5 and 6. The valves 5 and 6 are further connected by means of a conduit 9 to a compressed air storage vessel 7 which is connected to a pneumatic supply source 11 by a conduit 4 in which is situated a 2-position, 2-ported solenoid metering valve 8 for charging the vessel 7 with compressed air from the pressure source 11.

FIG. 1 shows the solenoid switching valves 5 and 6 in the position of rest and the piston 2 is situated at its left-hand terminal position. In order to perform a cutting step, the left-hand switching valve 5 is energized, between the left side of the pneumatic cylinder 1 and the pressurized air vessel 7 by means of the pressure conduit 9. Thereupon the piston 2 is propelled in the direction of the arrow 10 into its right-hand terminal position. Since the right-hand switching valve 6 is, during such cutting operation, switched to the venting position, there is generated only a slight braking effect by the air compressed by the travelling piston 2 in the right-hand chamber of the pneumatic cylinder 1. Subsequent to the cutting step the piston 2 is in its right-hand terminal position, and has consumed a significant proportion of the energy supplied from the vessel 7 in which no resupply of pressurized air from the source 11 occurs during the cutting stroke.

Thereafter the switching valve 5 is set to the venting position and the compressed air storage vessel 7 is recharged through the charging valve 8 to obtain a pressure of approximately 6 bar. Thus, the cutting device is ready for the subsequent cutting operation into the opposite direction by actuating the switching valve 6 It has been found that expediently the volume of the vessel 7 is from 1/10 to ⅓ (preferably from 1/5 to ⅛) the volume of the pneumatic cylinder 1. Or the capacity of the vessel is so designed that it is slightly larger than the required energy for performing the cutting step.

Because of its small mass and the absence of a counterpressure due to the vented cylinder, the pneumatically propelled piston 2 attains, after a very short travel, an extremely high speed of, for example, more than 5 m/sec. Because of the kinetic energy of the piston 2 consumed by the cutting operation proper and by the counterpressure derived from the air accumulating in front of the respective switching valve and since at the end of the cutting step the pneumatic driving force has dropped to approximately 1/6 of original magnitude, the braking effect which sets itself automatically in the pneumatic cylinder 1 (the so-called terminal positional damping) is entirely sufficient to stop the piston 2.

Turning now to the embodiment illustrated in FIG. 2, this construction differs from that shown in FIG. 1 solely in that the compressed air storage vessel is constituted by a pressure conduit 7′ which at its two opposite ends communicates directly with the switching valves 5 and 6, respectively. It is noted that FIG. 2 does not illustrate most of the components that are identical to the embodiment of FIG. 1.

Turning now to the embodiment illustrated in FIG. 3, instead of the sole compressed air storage vessel 7, two separate air storage vessels 7″ with associated separate metering valves 8 are provided. One of the vessels 7″, with the associated metering valve 8 is connected to the switching valve 5 while the other storage vessel 7″ with its associated metering valve 8 is connected to the switching valve 6. The two metering valves 8 are separately connected to the pressure source 11.

Reverting to FIG. 1, a continuous, cyclical, automatic operation of the cutting device may be effected by a control device 12 which applies periodic actuating signals to the switching valves 5 and 6 and the recharging valve 8 in response to sensors 13, 14 arranged at opposite ends of the cylinder 1 and triggered, for example, by the proximity of the piston 2 or the pressure conditions prevailing in the cylinder 1. The control circuit may include conventional timer components to delay recharging of the vessel 7 (particularly if only a single vessel 7 is used) until a cutting step is completed or launching of the piston 2 until the predetermined pressure in the vessel 7 is reached.

The sealing of the slit which extends in the pneumatic cylinder 1 along the entire length of the stroke of the piston 2 through which the connecting means between the piston 2 and the mount for the cutting blade 3 passes is effected in a conventional manner. Such an arrangement is described, for example, in an article by H. W. Hertsch entitled "Positionieren mit einem kolbenstangenlosen Zylinder" (Positioning by means of a Piston Rod-less Cylinder) which appeared in the periodical O & P ölhydraulik und pneumatik, Issue No. 10 of Vol. 24 (1980), page 785. The arrangement described in the article generally corresponds to the disclosure in German Pat. Document No. 2,162,572.

The invention advantageously provides that at the beginning of a cutting pass of the knife 3, the compressed air storage vessel contains, in the form of compressed air, an energy quantity which generally corresponds to that required for one cutting pass and which is thus substantially entirely consumed at the end of such a pass Since for performing a cutting pass the energy requirement may vary dependent upon the material to be severed, according to a further advantageous aspect of the invention, the energy quantity present after recharging the compressed air storage vessel may be varied. Since essentially the energy quantity is directly proportional to the pressure and the volume of air in the compressed air storage vessel, the invention provides for means to vary at least one of the two parameters. Thus, reverting to FIG. 1, the compressed air storage vessel 7 is composed of hermetically sealed telescoping parts 7*a* and 7*b* which may be longitudinally relatively movable with respect to one another to thus arbitrarily vary the volume of the compressed air storage vessel 7. In the example schematically illustrated, the telescoping part 7*b* is a fixed component while the telescoping part 7*a* is movable towards or away from the stationary part 7*b*. For facilitating such a motion, the pressure conduit 9 has a flexible loop part 15. It will be understood that in addition to or instead of a variable volume pressure vessel the pressure of the air in the pressure vessel may be varied, for example, by arbitrarily setting a different desired pressure for the compressed air storage vessel 7 in the control device 12. By providing within the vessel 7 a pressure sensor which applies signals to the control device 12, the metering valve 8 may be automatically shut off when the set pressure within the vessel 7 is reached.

The non-illustrated resin sheet which is supplied to the cutting device in a direction perpendicular to the plane of the drawing is, prior to cutting, freed of any covering film and is, during the cutting operation, immobilized by pneumatically actuated, rail-like clamping shoes which extend parallel to the cutting direction and along which the cutting blade is guided as close as possible.

In both end positions of the piston 2, in the zone of the cutting blade 3, there is arranged a contactless sensor, such as an optical barrier, which includes a light diode 16, 17 and an associated phototransistor or a photodiode 16' and 17' respectively. By means of this arrangement not only a breakage of the cutting blade may be monitored but also the function and the operational readiness of the cutting device may be continuously verified. The sensor may be coupled with a switching device for the sheet feed.

It will be understood that the above description of the present invention is susceptible to various modifications, changes and adaptations, and the same are intended to be comprehended within the meaning and range of equivalents of the appended claims.

What is claimed is:

1. A cutting device for severing sheet material comprising:

(a) a pneumatic cylinder defining a cylinder chamber having opposite first and second ends;

(b) a piston longitudinally slidably received in the cylinder chamber for executing working strokes between the first and second ends; said piston dividing said cylinder chamber into a first chamber part containing said first end and a second chamber part containing said second end;

(c) a cutting blade situated at least partially externally of the cylinder and being secured to the piston for travel with the piston as a unit;

(d) a pressurized air vessel means for storing pressurized air therein;

(e) a first and a second switching valve connected to said cylinder chamber at said first and second end, respectively, and to said pressurized air vessel means; said first and second switching valve each having a first position in which pneumatic communication is maintained between the pressurized air vessel means and a respective said cylinder chamber part and a second position in which the respective cylinder chamber part is vented;

(f) recharging means for recharging said pressurized air vessel means with pressurized air to a predetermined pressure solely prior to each working stroke of the piston and for allowing the pressure to diminish in said pressurized air vessel means during each working stroke of the piston to a point of substantial exhaustion of the energy derived from the pressurized air for driving the piston to execute each working stroke; and (g) means for coordinating operations of said first and second switching valves and said recharging means.

2. A cutting device as defined in claim 1, wherein said pressurized air vessel means comprises a sole pressurized air vessel connected to said first and second switching valve.

3. A cutting device as defined in claim 2, wherein said sole pressurized air vessel is a coupling conduit connecting said first switching valve with second switching valve.

4. A cutting device as defined in claim 1, wherein said pressurized air vessel means comprises a first pressurized air vessel connected to said first switching valve and a second pressurized air vessel connected to said second switching valve.

5. A cutting device as defined in claim 1, wherein said recharging means comprises a source of compressed air and a controllable recharging valve; said source being connected to said pressurized air vessel means through said controllable recharging valve.

6. A cutting device as defined in claim 1, further comprising sensor means situated at said ends for monitoring said cutting blade for breakage.

7. A cutting device as defined in claim 6, wherein said sensor means comprises an optical barrier.

8. A cutting device as defined in claim 7, wherein said optical barrier comprises a light diode and a photodiode.

9. A cutting device as defined in claim 1, wherein said switching valves are 2-position, 3-ported valves.

10. A cutting device for severing sheet material comprising:

(a) a pneumatic cylinder defining a cylinder chamber having opposite first and second ends;

(b) a piston longitudinally slidably received in the cylinder chamber for executing working strokes between the first and second ends; said piston dividing said cylinder chamber into a first chamber part containing said first end and a second chamber part containing said second end;

(c) a cutting blade situated at least partially externally of the cylinder and being secured to the piston for travel with the piston as a unit;

(d) a pressurized air vessel having a volume $\frac{1}{3}$ to 1/10 the volume of said cylinder chamber;

(e) a first and a second switching valve connected to said cylinder chamber at said first and second end, respectively, and to said pressurized air vessel; said first and second switching valve each having a first position in which pneumatic communication is maintained between the pressurized air vessel and a respective said cylinder chamber part and a second position in which the respective cylinder chamber part is vented;

(f) recharging means for recharging said pressurized air vessel with pressurized air to a predetermined pressure solely prior to each working stroke of the piston and for allowing the pressure to diminish in said pressurized air vessel during each working stroke of the piston; and (g) means for coordinating operations of said first and second switching valves and said recharging means.

11. A cutting device as defined in claim 10, wherein said pressurized air vessel means has a volume which 1/5 to $\frac{1}{3}$ the volume of said cylinder chamber.

* * * * *